US005084736A

United States Patent [19]

Suzuki et al.

[11] Patent Number: 5,084,736

[45] Date of Patent: Jan. 28, 1992

[54] IMAGE FORMING APPARATUS

[75] Inventors: Hajime Suzuki, Yokohama; Kouji Kimura, Tokyo; Yoshifumi Takehara, Yokohama, all of Japan

[73] Assignee: Canon Kabushiki Kaisha, Tokyo, Japan

[21] Appl. No.: 489,256

[22] Filed: Mar. 5, 1990

[30] Foreign Application Priority Data

Mar. 6, 1989 [JP] Japan ..... 1-051978
Aug. 31, 1989 [JP] Japan ..... 1-225493
Aug. 31, 1989 [JP] Japan ..... 1-225494

[51] Int. Cl.[5] ..... G03G 15/14

[52] U.S. Cl. ..... 355/271; 355/273; 355/277

[58] Field of Search ..... 355/271-273, 355/277-278, 280-281

[56] References Cited

FOREIGN PATENT DOCUMENTS 0281138 3/1988 European Pat. Off. .
0296334 4/1988 European Pat. Off. .
53-34468 3/1978 Japan .
0019751 2/1979 Japan ..... 355/277
0019752 2/1979 Japan ..... 355/271
0201272 12/1982 Japan ..... 355/277
59-17572 1/1984 Japan .
0053872 3/1984 Japan ..... 355/271
59-149157 10/1984 Japan .
59-195675 11/1984 Japan .

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus including a transfer material supporting device. An elastic member, a movable supporting member, a deformation preventing member or a friction member is provided between a transfer material supporting sheet and a frame constituting the transfer material supporting means or adjacent to the mounting position of the transfer material supporting sheet on the frame. By doing so, the transfer material supporting sheet is prevented from twisting or the like, so that images having good quality can be provided stably.

81 Claims, 9 Drawing Sheets

IMAGE FORMING APPARATUS

FIELD OF THE INVENTION AND RELATED ART

The present invention relates to an image forming apparatus of an electrophotographic process or electrostatic recording type, provided with an image transfer device for transferring an image formed on an image bearing member onto a transfer material supported on a flexible transfer material supporting sheet.

Various devices have been proposed and have been practically used to transfer onto a transfer material a toner image formed on an image bearing member in an image forming apparatus such as an electrophotographic apparatus or an electrostatic recording apparatus.

In one of them, the transfer material is supported on a rotatable transfer material supporting means, and a transfer corona discharge is applied from an inside of the supporting means toward the outside (toward the image bearing member), so that the toner image on the image bearing member in the form of a photosensitive drum or the like is transferred onto the transfer material. Such a type of transfer device is particularly suitable for a color image formation since plural color images can be superposedly transferred onto the transfer material in good order. In this case, however, it is required that the transfer material is uniformly contacted to the image bearing member to prevent occurrence of local non-transfer portion. In order to accomplish this, it is usual that a part of a periphery of a cylindrical member is cut away to form an opening, which is colored with a flexible transfer material supporting sheet made of insulating material and having a rectangular configuration to establish the transfer material supporting means. The transfer material supporting means is rotated in synchronization with the image bearing member. The four sides of the rectangular transfer material supporting sheet have been bonded to the cylindrical member to cover the opening.

Although it is possible with this structure to uniformly contact the transfer material to the image bearing member, it involves the following drawbacks. When the four sides of the flexible transfer material supporting sheet are bonded, it is difficult to bond it without slack, bend or inclination of the supporting sheet. The bonding work requires long time, and is not efficient. This applies to the case where an end of the transfer material supporting sheet is confined by a rigid member along the length of the transfer material. Particularly in order to avoid inclination or bend, it has taken a significantly long time.

When the part of the periphery of the cylindrical member is cut-away to provide the opening, a frame is formed which comprises a pair of rings and a connecting portion in the form of an elongated plate connecting the rings. Since the transfer material supporting sheet is stretched in the form of a part cylinder to cover the opening, the surface of the transfer material supporting sheet becomes wavy when the transfer material is stretched or shrinked due to the changes in the temperature and/or the humidity or due to the repeated transfer operation. If the wavy surface is produced, the transfer material is not property attracted or it is attracted with positional deviation, when the transfer material is supported on the supporting sheet. In addition, the image components in different colors are not registered in good order on the transfer material; the image is not uniform due to insufficient image transfer; or there occurs local non-transfer portions.

It is desirable that the transfer material supported on the flexible transfer material supporting sheet is in face-to-face contact during the transfer action. Particularly in the transfer system using a corona discharger as in a charging type transfer type, if the contact between the transfer material and the image bearing member during the transfer operation is a line contact, the image transfer of the toner image onto the transfer material and the separation of the transfer material from the image bearing member occur simultaneously, with the result of unstable transfer action, and therefore, extreme non-uniformity and insufficient image transfer efficiency.

In order to accomplish the face contact, Japanese Patent Application Publication No. 34468/1978 discloses that a part of the transfer material supporting sheet is pressed from the inside of the supporting frame at a position upstream of an image transfer position where the image bearing member and the transfer charger are faced to each other, with respect to the direction of the peripheral movement of the transfer drum. This is most often used. However, the freedom of deformation of the supporting sheet is different between the portions fixed to the frame and the other portions, and therefore, the surface contact is different depending on the positions in the supporting sheet. Therefore, the setting of the pressing force becomes difficult. This tends to cause non-transfer portions due to the insufficient pressure adjacent to the fixed portions.

As a measure for this problem, it is considered that the transfer region is made remote from the fixed portions of the transfer material supporting sheet. In that case, the outer diameter of the transfer material supporting means becomes large with the result of the bulky transfer device. In a transfer device wherein a plurality of transfer materials are supported on a transfer drum, the design thereof is preferably such that the outer diameter of the transfer material supporting means is not large. Making the transfer region remote from the fixed portions, as described above, results in production of non-transferable area in the supporting sheet. This requires additional space for the supporting of the transfer material supporting sheet, and therefore, the outer diameter of the transfer material supporting member is increased.

Japanese Laid-Open Utility Model Application No. 149157/1984 discloses a method wherein between the outer periphery of the ring and the transfer material supporting sheet, a first member made of elastic material and a second member at the transfer material supporting sheet side, the second member having a low friction coefficient. This method, however, involves the color component misregistration and the problem arising when the transfer material supporting sheet is bonded to the outer periphery of the frame.

SUMMARY OF THE INVENTION

Accordingly, it is a principal object of the present invention to provide an image forming apparatus wherein the transfer material can be properly receive the image.

It is another object of the present invention to provide an image forming apparatus wherein the transfer device is not bulky.

It is a further object of the present invention to provide an image forming apparatus wherein the transfer material supporting sheet can be easily mounted to a frame.

It is a further object of the present invention to provide an image forming apparatus wherein the transfer material supporting sheet is not slacked or twisted.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
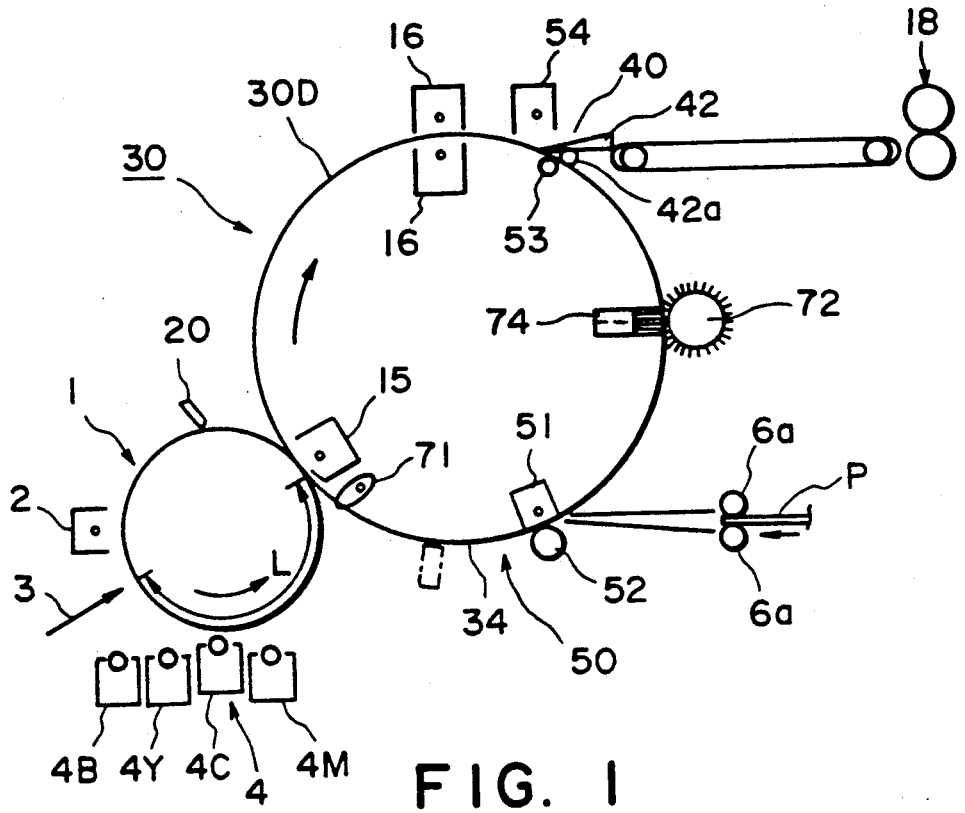
FIG. 1 sectional view of an image forming process executing portion of an image forming apparatus including an image transfer device, according to an embodiment of the present invention.

FIG. 1 shows a color image forming apparatus provided with an image transfer device, according to an embodiment of the present invention.

In the apparatus of this embodiment, an image bearing member, more particularly, an electrophotographic photosensitive drum 1 is supported for rotation in the direction of an arrow and is uniformly charged by a primary charger 2. Then, it is exposed to light image 3 in accordance with image information by exposure means including laser beam exposure means (not shown), for example, by which an electrostatic latent image is formed on the photosensitive drum 1. The electrostatic latent image is visualized into a toner image on the photosensitive drum 1 by a movable developing device 4, for example.

The movable developing device 4 has four developing devices 4M, 4C, 4Y and 4B for containing four color developers, i.e., a magenta developer, a cyan developer, a yellow developer and a black developer, and a guide (not shown) for supporting the four developing devices and movable in a horizontal plane. The movable developing device 4 presents to a developing position where it is faced to the outer periphery of the photosensitive drum 1 to develop the electrostatic latent image on the photosensitive drum 1.

The visualized image, that is, the toner image on the photosensitive drum 1 is transferred onto a transfer material P contacted to the photosensitive drum 1 by a transfer device 30 which will be described in detail hereinafter. The transfer material P is supplied to the transfer device 30 in synchronism with the image by registration rollers 6*a*.

The surface of the photosensitive drum is cleaned by a cleaning device such that the residual toner on the surface is removed therefrom, and is prepared for the next color image formation process.

The transfer device 30 of this embodiment comprises transfer material attracting means 50 for attracting and retaining or supporting the transfer material P on a flexible transfer material supporting sheet 34. The transfer material supporting sheet 34 is made of PVdF (polyvinylidene fluoride). The transfer material attracting means 50 includes an attraction corona charger 51 which is disposed inside the substantially cylindrical transfer drum 30D (transfer material supporting means)

and which serves to apply to the backside of the transfer material supporting sheet 34 electric charge having the polarity opposite to that of the toner image on the photosensitive drum 1, and a conductive roller 52 disposed outside the transfer drum 30D. The conductive roller 52 is grounded to function as an opposite electrode for the attraction corona charger 51, and also functions to inject the electric charge into the transfer material P so that the transfer material P is electrostatically attracted onto the transfer material supporting sheet 34.

The transfer material P attracted by the transfer material attracting means 51 and 52 is conveyed to the image transfer region where the transfer charger 15 is disposed. The transfer corona charger 15 applies electric charge having the polarity opposite to that of the toner onto the backside of the transfer material supporting sheet 34 in order to transfer onto the first transfer material P the first color toner image, for example, a magenta toner image from the photosensitive drum 1. Subsequently the same latent image is formed on the photosensitive drum 1 and is developed with the first color toner, and the first color toner image is transferred onto the second transfer material in the similar manner. By the time the first transfer material reaches again the position of the conductive roller 52, the conductive roller 52 is released, by which it is retracted away from the transfer material supporting sheet to a position not disturbing the toner image on the transfer material P, by, for example 2 mm or more.

Then, a second color toner image formed on the photosensitive drum 1 in synchronism with the first transfer material now having the first color toner image, is transferred onto the first transfer material P by the transfer corona charger 15, and similarly, the second color toner image is also transferred onto the second transfer material having the first color toner image. In the similar manner, four color toner images are transferred onto the two transfer materials P.

Figure 2:
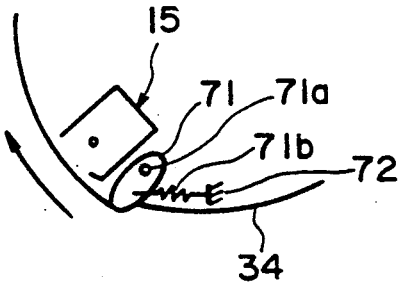
FIG. 2 is a sectional view of a part of the transfer drum at an image transfer position where a toner image is transferred from the photosensitive drum to the transfer material on the transfer drum.

As shown in FIG. 2, in order to assist the transfer of the toner image, a pressing lever 71 is provided adjacent to and at the upstream side of the transfer corona charger 15 with respect to the rotational direction of the transfer material supporting means. The pressing lever 71 urges the transfer material supporting sheet 34 to the photosensitive drum in the transfer region to increase the contact width of the transfer region so as to stabilize the transfer action of the toner image. The pressing lever 71 is pivotable about a shaft 71*a*, and the pressing force is determined by a tension spring 71*b* stretched between the pressing lever 71 and a fixed portion 72.

Figure 3:
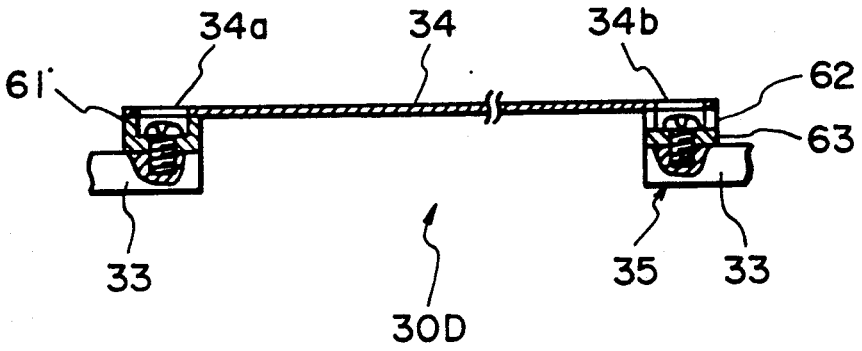
FIG. 3 is a sectional view of transfer material supporting means of elastic material, according to the present invention.
Figure 4:
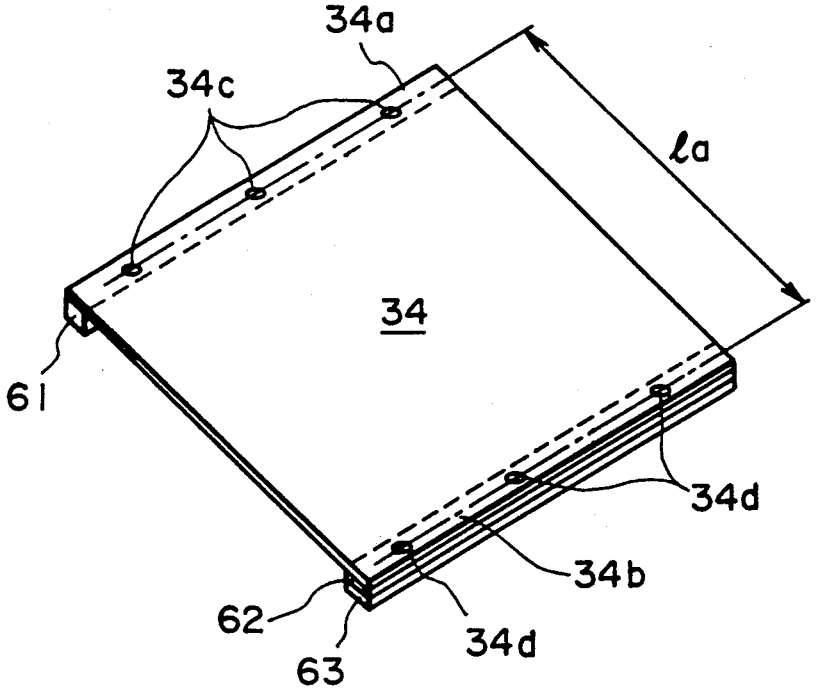
FIG. 4 is a perspective view of the transfer material supporting means.

Referring to FIGS. 3 and 4, the transfer device 30 of this embodiment will be further described. In FIGS. 3 and 4, the transfer material supporting sheet is shown as being developed in cross-section and is shown in a perspective view, respectively.

One end 34*a* of the flexible transfer material supporting sheet 34 (one of the leading circumferential ends of the sheet 34) is bonded on a rigid member 61 (supporting member for the transfer material supporting sheet) by a double-sided adhesive tape or the like. The rigid member 61 is provided with through holes for screws and recesses for sinking the screw heads. The other end 34*b* of the supporting sheet 348 (the trailing circumferential end of the sheet 34 is bonded on a rigid member 63 through an elastic member 62 may be urethane foam, rubber or the like. In this embodiment, the elastic member 62 is provided with recesses to sink the screw heads, and the rigid member 63 is provided with holes for the screws. In addition, the end portions 34*a* and 34*b* of the transfer material supporting sheet 34 are provided with holes 34*c* and 34*d* for allowing the screw heads to sink.

The transfer material having been subjected to the image transfer operation, is separated from the transfer material supporting sheet 34 by separating means, and is conveyed to the downstream fixing rollers 18. The separating means 40, as disclosed in U.S. patent application Ser. No. 332,721, deforms the sheet 34 by a roller 53 disposed inside the sheet 34 to raise it. Below the raised edge of the transfer material, a separating pawl 42 is inserted to separate the transfer material with movement of the sheet 34. A roller 42*a* of the separating pawl 42 functions as a spacer for preventing damage to the sheet 34 by the pawl 42.

Figure 5:
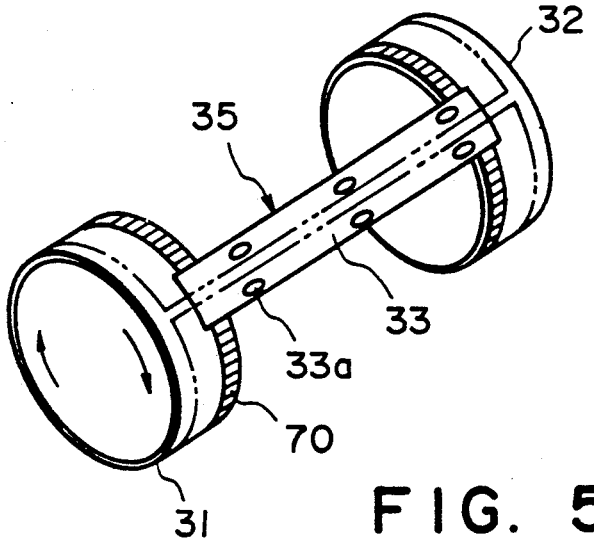
FIG. 5 shows an embodiment wherein a friction member is provided for the frame of the transfer material supporting means.

As shown in FIG. 5, the transfer device 30 includes cylindrical rings 31 and 32 at opposite longitudinal ends and a connecting member 33 for connecting the rings 31 and 32. They cooperates to constitute a drum frame 35 of the transfer drum 30D. The rings and the connecting member may be integrally formed. The connecting portion 33 is provided with screw holes 33*a* along two longitudinal lines. The longitudinally inside portions of the outer circumferential peripheries of the rings 31 and 32, which are contacted to the transfer material supporting sheet 34, are provided with friction members 70 bonded thereto, the friction member 70 being made of rubber and having a predetermined frictional coefficient. The combination of the transfer material supporting sheet 34, the elastic member 62 and the rigid member 63 is detachably mountable to the frame 35 having the connecting portion 33.

Figure 6:
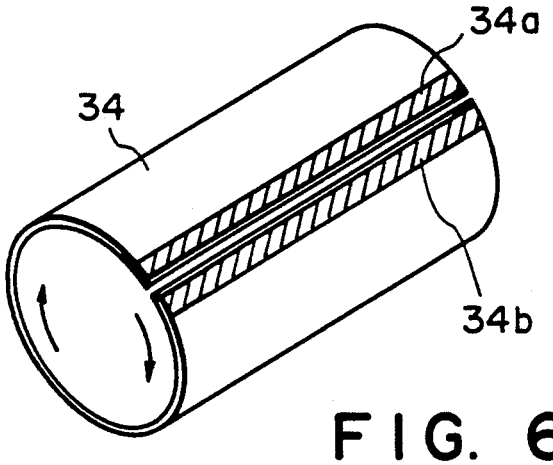
FIG. 6 is a perspective view of a transfer material supporting sheet bent so as to be mounted on the frame.
Figure 7:
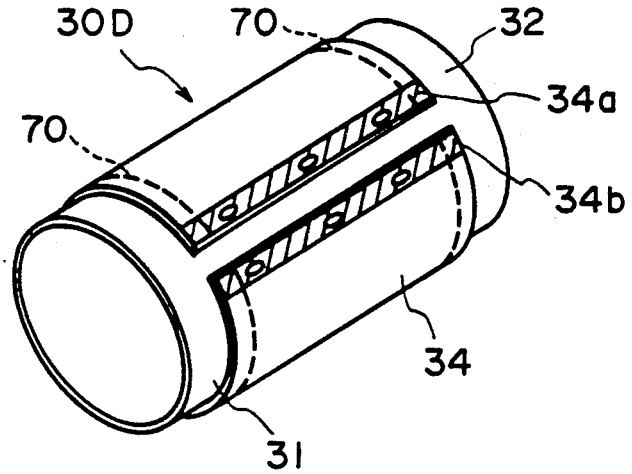
FIG. 7 is a perspective view of the transfer material supporting means having the transfer material supporting sheet mounted on the frame.

As shown in FIGS. 6 and 7, when the transfer material supporting sheet 34 is mounted on the drum frame 35, the sheet 34 is curved into a cylindrical form over the drum frame 35, and then the rigid members 61 and 63 are fixed to the connecting portion 33 by threading screws into the holes 33*a* of the connecting portion 33 through the holes of the rigid members 61 and 62 formed adjacent the leading and trailing end portions of the sheet 34. Since the sheet 34 is mounted on the drum in this manner, it is apparent that there are portions where the sheet 34 is not fixed to the rings 31 or 32.

Figure 8:
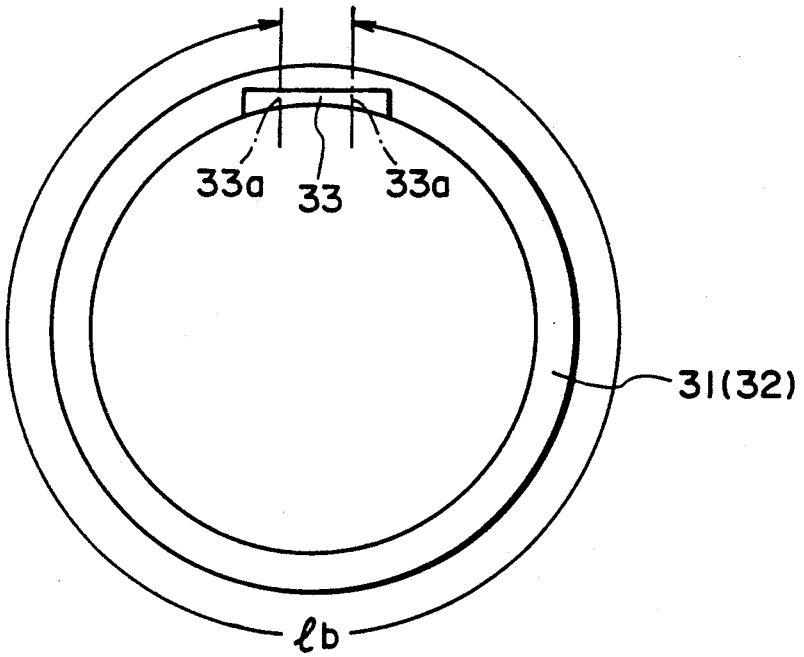
FIG. 8 is a sectional view of the transfer material supporting means shown in FIG. 7, showing the dimensional relation.

As shown in FIG. 8, an interval 1*a* between the screw holes of the rigid member 61 and the screw holes of the rigid member 63 (which is equal to the interval between the recesses 34*c* and 34*d* of the transfer material supporting sheet 34) satisfies, relative to the interval 1*b* between the two lines of the screw holes 33*a* of the connecting portion 33 when the supporting sheet 34 is mounted on the frame, the following:

$$1a = 1b + \alpha (\alpha > 0)$$

where $\alpha$ is a margin which is properly determined by one skilled in the art in consideration of the expansion and/or shrinkage of the transfer material supporting sheet 34 due to the change in the ambient conditions and in consideration of the color component image registration in the case of plural images are superposedly transferred.

In this embodiment, as described above, by not directly bonding the transfer material supporting sheet 34 to the connecting portion 33, the stretched state of the sheet 34 when it is mounted on the drum frame is controllable using the margin $\alpha$. This makes the sheet 34 exchanging operation easy.

According to this embodiment, the transfer material supporting sheet 34 may be easily mounted to provide a predetermined stretched state (tension force) without relying on the expertise. The difference in the freedom of deformation of the sheet 34 between the fixed portion and the other portion is decreased, so that the possibility of image transfer failure is decreased. In addition, there is disposed a friction member 70 having a predetermined frictional coefficient between the rings 31 and 32 and the supporting sheet 34, and therefore, the sheet 34 is prevented from deviation in the axial direction of the drum 30D.

The description will be made as to the frictional coefficient of the friction member 70. If the friction coefficient of the friction member 70 is small, the color component images are not registered, as described hereinbefore. However, if it is too large, the same results as when the opposite ends of the supporting sheet 34 are fixed by the double sided adhesive tape or the like, are produced, so that the local non-transfer occurs, as described hereinbefore. The experiments by the inventors have revealed that urethane rubber or neoprene rubber or the like have good friction coefficient.

In this embodiment, the elastic member 62 is used at the trailing circumferential edge of the supporting sheet 34, by which the flexibility of deformation of the sheet 34 is increased adjacent to the fixed end of the sheet 34. When the elastic member 62 is used at both of the leading and trailing ends of the sheet 34, the deformation flexibility of the sheet 34 is further enhanced.

Referring back to FIG. 1, the supporting sheet 34 is cleaned by a cleaning brush 72 when there is no transfer material P on the sheet 34. At this time, it is urged to the cleaning brush 74 by a back-up brush 74, upon which a gap 76 is produced between the friction member 70 and the sheet 34 at the position where it is urged. The gap 76 is so small that the other portion of the supporting sheet 34 is not deviated by the friction between the friction member 70 and the sheet 34.

Figure 9:
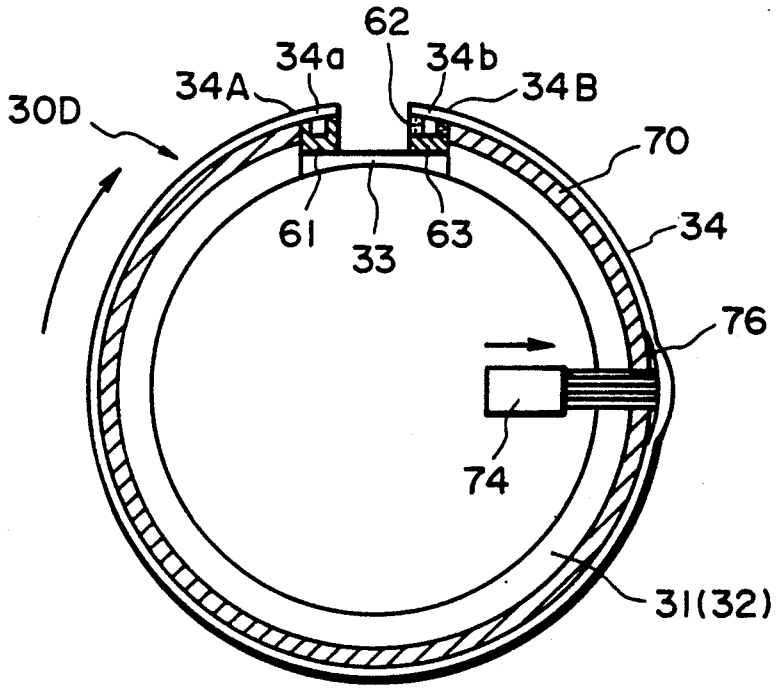
FIG. 9 is a sectional view of a transfer material supporting means of FIG. 6.

However, the gap 76 (FIG. 9) advances together with the rotation of the transfer drum 30D in the rotational direction of the transfer material supporting sheet 34 from a starting point 34A to the ending point 34B, by which the deformation of the sheet 34 with time of use, due to temperature and/or humidity factors is accommodated. Therefore, the transfer material supporting sheet 34 is prevented from waving, stretching and shrinkage both in the axial and circumferential directions of the transfer drum 30D.

Figure 10:
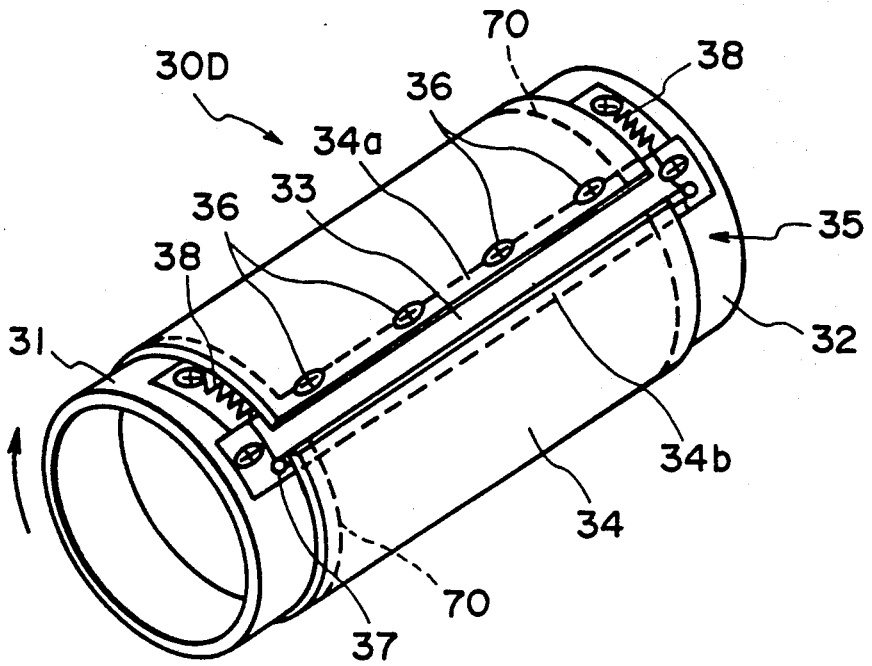
FIG. 10 is a perspective view of a transfer material supporting means having a spring.

Referring to FIG. 10, there is shown a transfer drum of an image transfer device according to another embodiment of the present invention. In this Figure, the same reference numerals as in FIGS. 2–9 are assigned to the elements having the corresponding functions.

Figure 10A:
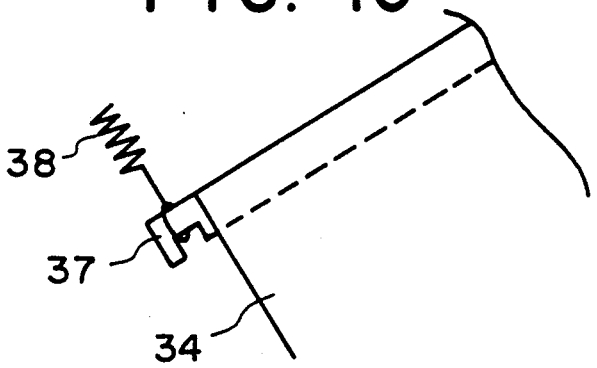
FIG. 10A is an enlarged view of the supporting member shown in FIG. 10.

FIG. 10A is an enlarged view of the supporting member 37 of FIG. 10.

In the transfer device of this embodiment, the leading end **34*a* of the transfer material supporting sheet 34 on the transfer drum 30D is directly fixed by screws 36 or the like to the connecting portion 33 for connecting the rings 31 and 32 constituting the drum frame 35 therewith. The trailing end 34*b* of the sheet 34 is fixed on a supporting member 37 for supporting the sheet 34. The supporting member 37 is pulled by urging members such as tension springs 38 or the like so that the transfer material supporting sheet 34 is not slacked, and the springs 38 are fixed on the rings 31 and 32, respectively. The longitudinally inside portions of the outer circumferential periphery of the rings 31 and 32 which are contacted to the transfer material supporting sheet 34 are provided with the friction members 70** bonded thereto, similarly to the foregoing embodiment. The same advantageous effects can be provided with the structure of this embodiment.

Figure 11:
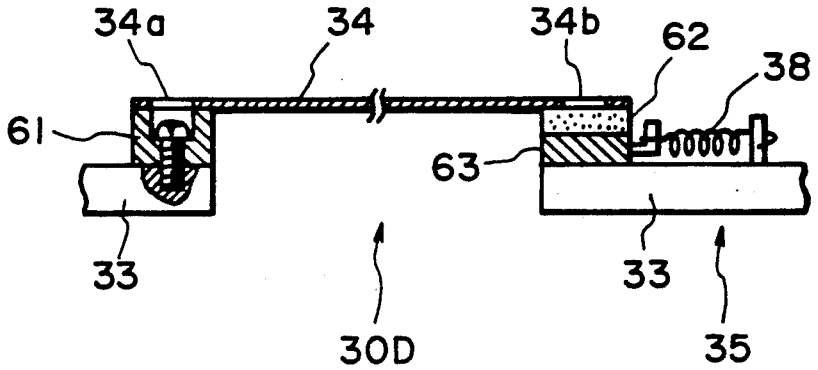
FIG. 11 is a sectional view of the transfer material supporting means according to a further embodiment of the present invention wherein an elastic member is added to the transfer material supporting means having the spring.

FIG. 11 is a longitudinal sectional view of the transfer material supporting sheet mounting portion in a transfer device according to a further embodiment of the present invention.

The leading end **34*a* of the transfer material supporting sheet 34 is mounted through a rigid member 61 to the connecting portion 33 for connecting the rings 31 and 32 to constitute the drum frame 35 of the transfer drum 30D, and the trailing end 34*b* thereof is mounted on a rigid member 63 through an elastic member 62. The rigid member 63 is urged by tension springs 38** or the like.

The longitudinally inside portions of the outer circumferential peripheries of the rings 31 and 32 which are contacted to the transfer material supporting sheet 34 are provided with the friction members 70 bonded thereto, similarly to the foregoing embodiments.

The same advantageous effects can be provided with the structure of this embodiment.

Figure 12:
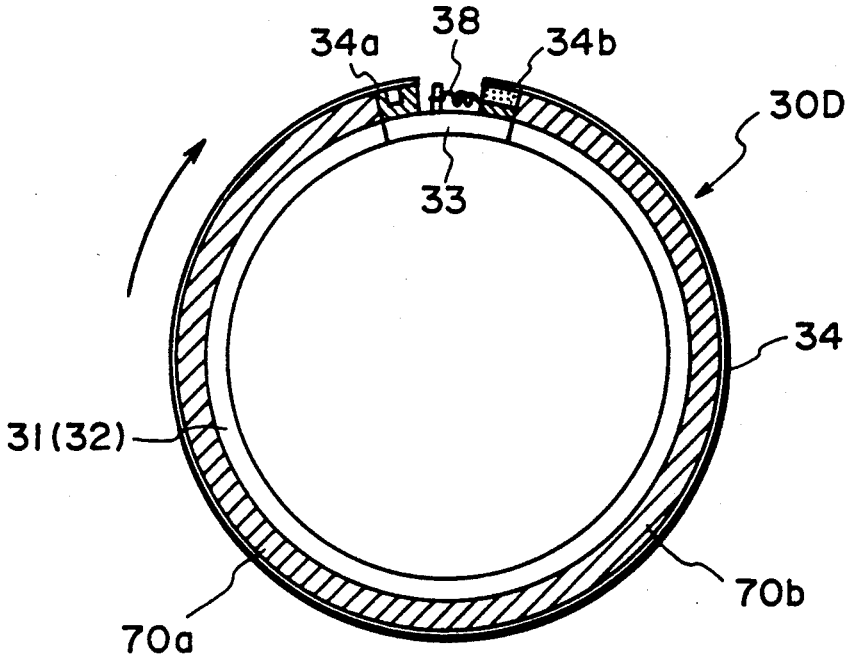
FIG. 12 is a sectional view of the transfer material supporting means similar to that shown in FIG. 11 but which is added by a friction member.

FIG. 12 is a cross-sectional view of a transfer drum of a transfer device according to a further embodiment of the present invention.

The transfer device of this embodiment includes friction members **70*a* and 70*b* having different friction coefficients. They are mounted on each of the longitudinally inside portions of the circumferential outer peripheries of the rings 31 and 32 constituting the drum frame 35 of the transfer drum 30D. The friction coefficient of the friction member 70*b* at the side including the trailing end 34*b* of the transfer material supporting sheet 34 (trailing side of the image) is smaller than the friction coefficient of the friction member 70*a* at the side including the leading end 34*a* of the transfer material supporting sheet 34** (the leading side of the image).

Because of this difference, the stretching force by the springs 38 is non-uniformly distributed in the transfer material supporting sheet 34 by the friction members **70*a* and 70*b*, more particularly, the leading side of the sheet 34 is stretched with relatively strong force, and the trailing side is stretched with relatively small force. Therefore, at the leading side of the image which is important from the standpoint of the registration of the color component images, the transfer material supporting sheet 34 is not deviated; and at the trailing side of the sheet 34, it is more flexible in the circumferential direction to absorb the entire slack of the sheet 34**.

Figure 13:
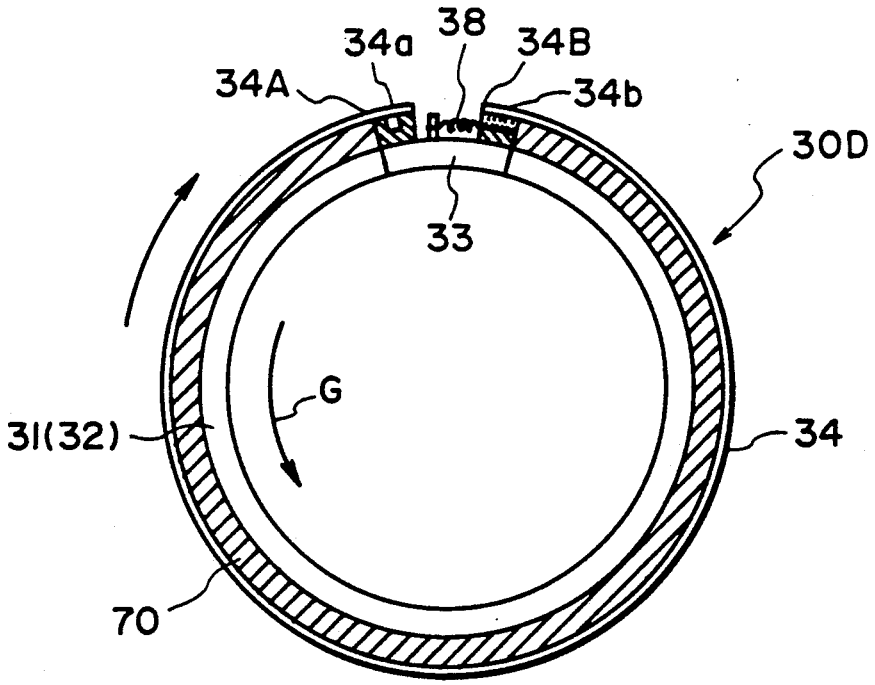
FIG. 13 is a sectional view of a transfer material supporting means having a friction member which is different from that of FIG. 12.

FIG. 13 is a cross-sectional view of the transfer drum in a transfer device according to a further embodiment of the present invention. In this embodiment, the friction member 70 provided in the longitudinally inside portions of the outer circumferential peripheries of the rings 31 and 32 constituting the drum frame 35 of the transfer drum 30D, at which the rings 31 and 32 are contacted to the transfer material supporting sheet 34, has friction coefficient which decreases away from the leading end **34*a* toward the trailing end 34*b* with respect to the rotational direction of the transfer material supporting sheet 34**.

Figure 14:
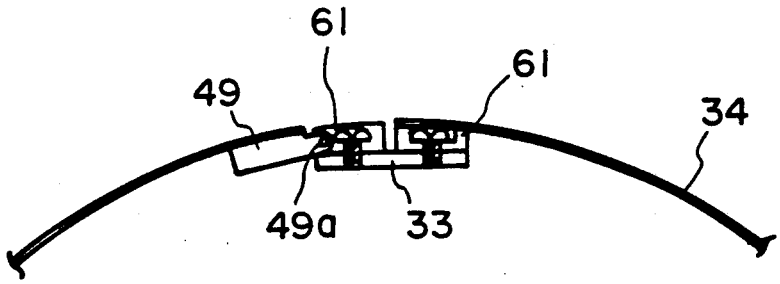
FIG. 14 is a sectional view of a transfer material supporting means according to a further embodiment of the present invention wherein it is provided with a movable supporting member at an end of the transfer material supporting sheet.
Figure 15:
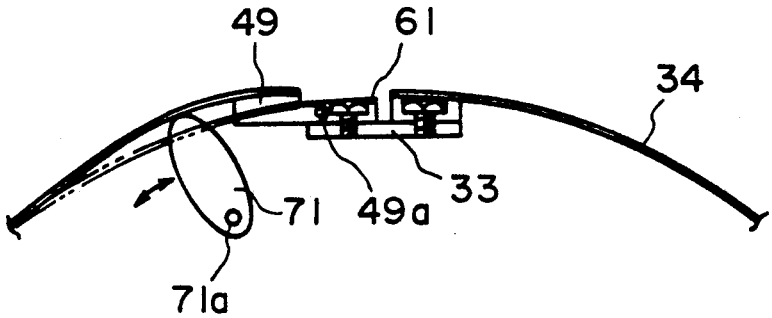
FIG. 15 is a sectional view of the transfer material supporting means of FIG. 14, wherein a pressing member acts thereon.

Using such friction member 70, the friction coefficient thereof can be changed continuously, so that the effect of removing the slack of the transfer material supporting sheet 34 is further improved. Referring to FIGS. 14 and 15, a further embodiment of the present invention will be described. As shown in FIG. 14, both of the leading and trailing ends of the transfer material supporting sheet 34 are provided with supporting members 61, through which the transfer material supporting sheet 34 is fixed to the connecting portion 33. To one of the supporting members 61, a rigid movable supporting member 49 is connected through a pin 49*a*. To the movable member 49, an end of the transfer material supporting sheet 34 is bonded. As shown in FIG. 15, even if the urging means 71 urges the transfer material supporting sheet 34, the movable supporting member 49 rotates about the pin 49*a* so as to permit free deformation of the transfer material supporting sheet 34 even at the position adjacent to the supporting member 61. Therefore, the similar advantages as when the elastic member 62 can be provided.

In this embodiment, the transfer material supporting sheet 34 can be fixed on the rigid movable supporting member 49, and therefore, the transfer material supporting sheet 34 is prevented from waving or slacking at the mounting position, it is preferable that the movable supporting member 49 is mounted to the leading end rather than mounting it at the trailing end, because the twisting of the transfer material supporting sheet 34 adjacent to the leading end is more influential to the image than that adjacent the trailing end.

Figure 16:
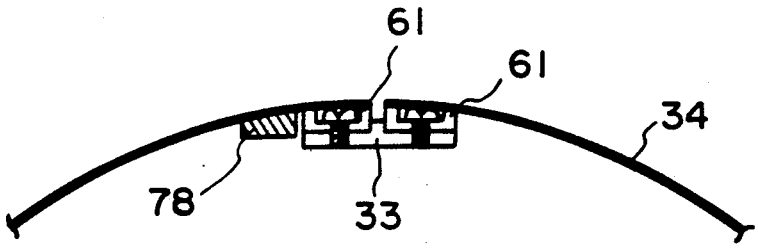
FIG. 16 is a sectional view of a transfer material supporting means, according to a further embodiment of the present invention, wherein the transfer material supporting sheet is provided with a deformation preventing member at an end thereof.

FIG. 16 illustrates a further embodiment, wherein the opposite ends of the transfer material supporting sheet 34 are bonded on supporting members 61, and adjacent to one of the supporting members 61, a sheet deformation preventing member 78 such as a block member is bonded to the transfer material supporting sheet 34, extending along the connecting portion 33, by which the deformation such as the waving or slack of the transfer material supporting sheet 34 which tends to occur adjacent to the supporting member 61, can be prevented. The block member 78 extends in the longitudinal direction of the transfer material supporting means.

In this embodiment, the movable supporting member 49 or the block member 78 is employed only for one of the supporting members 61, but it may be used for each of them. In that case, the advantageous effects are doubled.

Figure 17:
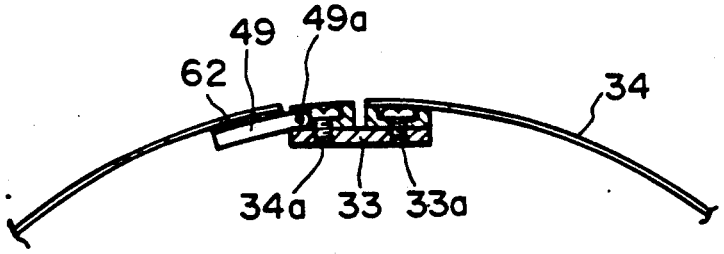
FIG. 17 shows a further embodiment, wherein an elastic member is added to the transfer material supporting means.
Figure 18:
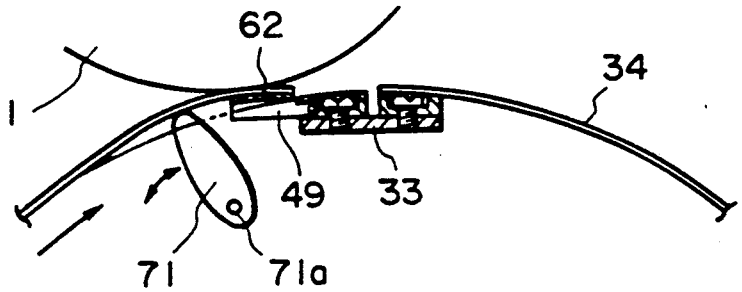
FIG. 18 shows a further embodiment wherein an elastic member is added to the transfer material supporting means of FIG. 15.

Referring to FIGS. 17 and 18, are further embodiment will be described. This embodiment is a modification of FIGS. 14 and 15 embodiments, and an elastic member 62 is provided between the transfer material supporting sheet 34 and the movable supporting member 49. With this mounting method of the transfer material supporting sheet 34, the movable supporting member 49 moves to the position of the urging lever 71 when the transfer drum 30D rotates, so that the leading portion of the sheet 34 is raised by the lever 71 toward the photosensitive drum 1.

At this time, the raising by the urging lever 71 abuts the movable supporting member 49 to the photosensitive drum 1. Since, however, the elastic member 62 is sandwiched between the movable supporting member 49 and the transfer material supporting sheet 34, the impact due to the abutment of the movable supporting member 49 is eased, and therefore, the toner is not fused on the photosensitive drum 1 by the impact. Also, since the leading portion of the transfer material supporting sheet 34 is linearly supported along the axis of the drum 30*d* by the movable supporting member 49, the waving or the twisting in the axial direction can be prevented even when cut-away portion or portions are formed at the leading side.

Figure 19:
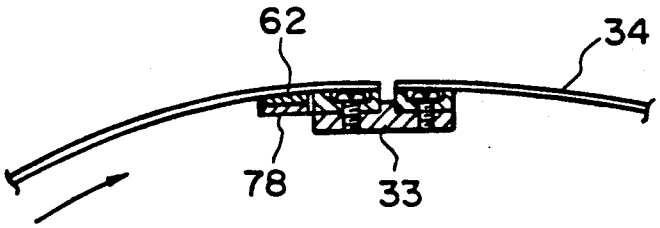
FIG. 19 shows a further embodiment, wherein an elastic member is added to the transfer material supporting means of FIG. 16
Figure 20:
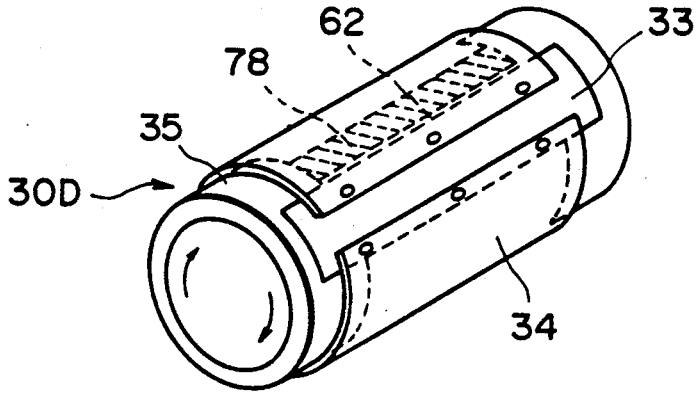
FIG. 20 is a perspective view of the transfer material supporting means of FIG. 19.

FIGS. 19 and 20 show a further embodiment. This embodiment is a modification of the FIG. 16 embodiment. In this embodiment, an elastic member 62 is provided between the transfer material supporting sheet 34 and the block member 78.

By the mounting method of the transfer material supporting sheet 37, a desired contact area between the photosensitive drum 1 and the transfer material can be assured by the urging lever 71 urging the movable block 78 the leading portion of the sheet 34 through the movable block 78 toward the photosensitive drum 1. Here, the block 78 is stated as being movable, since, as will be understood from the Figure, the block slightly pivots about a portion of the sheet between the supporting member 61 and the block member 78 (longitudinal direction of the transfer material supporting means). The impact by the abutment of the movable block 78 to the photosensitive drum 1 is eased by the provision of the elastic member 62 to prevent the possible toner fusing on the photosensitive drum 1 which can be caused by the impact. By the supporting with the use of the movable block 78, the waving or the twisting in the axial direction can be prevented even when the cut-away portion or portions are provided at the leading edge of the sheet 34.

Figure 21:
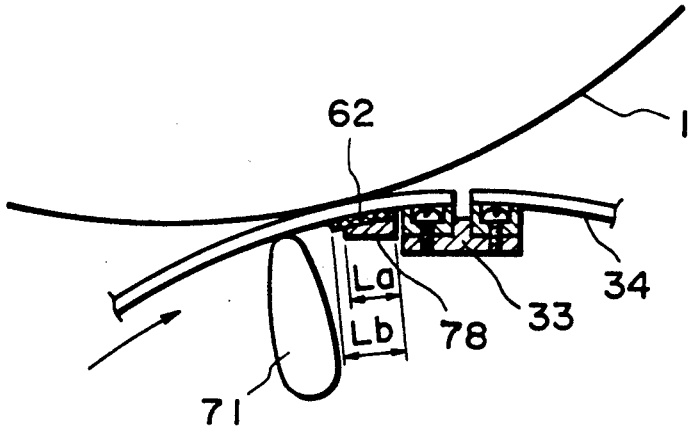
FIG. 21 is a sectional view of a transfer material supporting means wherein the elastic member in FIG. 19 is enlarged in a direction of the rotation of the transfer drum.

As shown in FIG. 21, the width La of the movable block 78 measured in the circumferential direction of the transfer drum 30*d* is preferably smaller than a width Lb of the elastic member 62. (Lb>La), and that the elastic member 62 is projected from the movable block 78 away from the connecting portion 33. By doing so, the following advantages are provided. The leading end of the transfer material supporting sheet 34 is urged to the photosensitive drum 1 through the movable block 78 by an urging lever 71. When the lever 71 is away from the movable block 78 with the rotation of the transfer drum 30D, the lever 71 immediately abuts the sheet 34. Therefore, there is a likelihood depending on the urging force by the lever 71, though, that the impact by the abutment deviates the transferred toner image onto the transfer material supported by the sheet 34.

By making the width Lb of the elastic member 62 larger than the width La of the movable block 78, and by projecting the elastic member 62 from the movable block 78, the lever 71 abuts the elastic member 62 when the lever 71 is away from the movable block 78. Therefore, the impact is absorbed, and only then it abuts the sheet 34, thus easing the impact by the abutment of the lever 71 to the sheet 34. Therefore, the deviation of the transferred toner image on the transfer material supported on the sheet 34 can be prevented.

Figure 22:
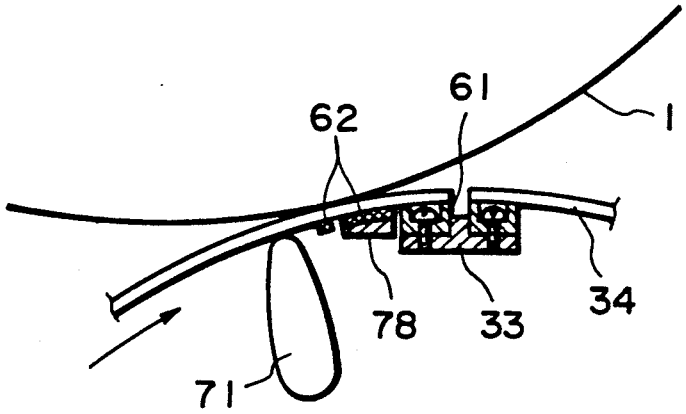
FIG. 22 is a sectional view of a transfer material supporting means according to a further embodiment of the present invention, wherein it is provided with an elastic member close to an elastic member having the same dimension as a deformation preventing means.

As shown in FIG. 19, a small elastic member may be disposed adjacent to the elastic member 62 having the same size as the block 78. The same advantageous effects as in FIG. 21 can be provided (FIG. 22).

By doing so, the sheet deformation occurring between the block 78 and the downstream side of the sheet can be further prevented.

The above advantageous effects can be provided similarly by making the width of the elastic member 62 larger than the width of the movable supporting member 49 to project the elastic member 62 from the movable supporting member 49 in the foregoing embodiments.

In the foregoing embodiments, both of the leading and trailing ends of the transfer material supporting sheet 34 are fixed to the connecting portion 33 constituting the frame 35 of the transfer drum 30D. However, at least one of the leading and trailing end of the sheet 34 may be engaged with the connecting portion 33 through elastic means such as a tension spring for applying tension to one of the leading end and the trailing end, for example. The same advantages can be provided thereby.

As described in the foregoing embodiment, in the transfer device having the structure absorbing the movement of the transfer material supporting sheet, the means for separating the transfer material from the transfer material supporting sheet may preferably use the deformation of the sheet.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, and a frame having ring portions at longitudinal opposite ends of the transfer material supporting means and a connecting portion for partially connecting the ring portions to provide an opening defined by the ring portions and the connecting portion, said transfer material supporting means further including an elastic member for supporting the transfer material supporting sheet, wherein the frame supports the transfer material supporting sheet covering the opening, and the transfer material supporting sheet is at least partly unfixed to the ring portions, and wherein the elastic member extends along a longitudinal direction of said transfer material supporting means, wherein said transfer material supporting means includes between the elastic member and the frame a supporting member for supporting the elastic member.

2. An apparatus according to claim 1, wherein said transfer material supporting sheet rotates in contact with said image bearing member at the transfer position.

3. An apparatus according to claim 1, further comprising image transfer means inside the frame.

4. An apparatus according to claim 1, wherein plural color images are transferred from said image bearing member to the transfer material to provide a full-color image.

5. An apparatus according to claim 1, further comprising attracting means for electrostatically attracting the transfer material onto the transfer material supporting sheet.

6. An apparatus according to claim 1, further comprising stretching means, disposed in contact with the transfer material supporting sheet at a side thereof remote from said image bearing member, for stretching the transfer material supporting sheet.

7. An apparatus according to claim 6, wherein said stretching means is effective to increase a contact width between said image bearing member and the transfer material supporting sheet.

8. An apparatus according to claim 1, wherein at least one of the leading and trailing ends of the transfer material supporting sheet with respect to a rotational direction of said transfer material supporting means is fixed to the frame.

9. An apparatus according to claim 8, wherein said at least one of the ends is fixed to the connecting portion of the frame.

10. An apparatus according to claim 1, wherein said supporting member is effective to prevent deformation of the elastic member and the transfer material supporting sheet supported thereby.

11. An apparatus according to claim 1, wherein the transfer material supporting sheet is detachably mountable to said frame.

12. An apparatus according to claim 1, wherein a combination of the transfer material supporting sheet, the elastic member and the supporting member for the elastic member is detachably mountable to the frame.

13. An apparatus according to claim 1, wherein at least a part of the transfer material supporting sheet is unfixed to the frame at opposite longitudinal ends of the transfer material supporting means.

14. An apparatus according to claim 1, wherein the elastic member is provided at least at one of the leading and trailing ends of the transfer material supporting sheet with respect to a rotational direction of said transfer material supporting means.

15. An apparatus according to claim 1, wherein the elastic member is of urethane foam or rubber.

16. An apparatus according to claim 1, wherein said frame supports for movement a trailing end of the transfer material supporting sheet with respect to a rotational direction of said transfer material supporting means.

17. An apparatus according to claim 1, wherein the elastic member is supported on the connecting portion together with the transfer material supporting sheet.

18. An apparatus according to claim 1, wherein the elastic member is elongated extending a longitudinal direction of said transfer material supporting means.

19. An apparatus according to claim 1, wherein said transfer material supporting means includes a stretching member for stretching the transfer material supporting sheet relative to the frame in a circumferential direction.

20. An apparatus according to claim 19, wherein said stretching member connects an end of the transfer material supporting sheet and the frame to apply tension to the transfer material supporting sheet.

21. An apparatus according to claim 1, wherein when the transfer material is separated from the transfer material supporting sheet, the supporting sheet is deformed.

22. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, a frame for supporting the transfer material supporting sheet, and a movable supporting member for supporting for movement the transfer material supporting sheet relative to the frame;

wherein said movable supporting member is disposed adjacent to an end of the transfer material supporting sheet in a rotational direction of said transfer material supporting means, and is movable relatively to the frame; and further comprising stretching means, disposed in contact with the transfer material supporting sheet at a side thereof remote from said image bearing member, for stretching the transfer material supporting sheet.

23. An apparatus according to claim 22, wherein the end is a leading end of the transfer material supporting sheet with respect to the rotational direction of said transfer material supporting means.

24. An apparatus according to claim 22, wherein said transfer material supporting sheet rotates in contact with said image bearing member at the transfer position.

25. An apparatus according to claim 22, further comprising image transfer means inside the frame.

26. An apparatus according to claim 22, wherein plural color images are transferred from said image bearing member to the transfer material to provide a fullcolor image.

27. An apparatus according to claim 22, wherein said transfer material supporting means is generally in the form of a drum.

28. An apparatus according to claim 22, further comprising attracting means for electrostatically attracting the transfer material onto the transfer material supporting sheet.

29. An apparatus according to claim 22, wherein said stretching means is effective to increase a contact width between said image bearing member and the transfer material supporting sheet.

30. An apparatus according to claim 22, wherein said frame includes ring portions at its longitudinal ends and a connecting portion for connecting the rings to provide an opening defined by the ring portions and the connecting portion, wherein the opening is covered by the transfer material supporting sheet.

31. An apparatus according to claim 22, wherein said at least one of the leading and trailing ends of the transfer material supporting sheet with respect to the rotational direction of said transfer material supporting means is fixed to the frame.

32. An apparatus according to claim 31, wherein said at least one of the ends is fixed to the connecting portion of the frame.

33. An apparatus according to claim 22, wherein the transfer material supporting sheet is detachably mountable to the frame.

34. An apparatus according to claim 22, wherein at least a part of the transfer material supporting sheet is unfixed to the frame at opposite longitudinal ends of the transfer material supporting means.

35. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, and a frame having ring portions at longitudinal opposite ends of said transfer material supporting means and a connecting portion for partly connecting the ring portions to provide an opening defined by the ring portions and the connecting portion, wherein the frame mounts thereon the transfer material supporting sheet to cover the opening;

wherein said transfer material supporting means further including a member for preventing deformation of the transfer material supporting sheet, said deformation preventing member extending along a longitudinal direction of said transfer material supporting means and being mounted on the transfer material supporting sheet close to the connecting portion.

36. An apparatus according to claim 35, wherein said transfer material supporting means includes a first elastic member between the transfer material supporting sheet and the deformation preventing member.

37. An apparatus according to claim 35 or 36, wherein the transfer material supporting sheet is provided with a second elastic member close to the deformation preventing member across the connecting portion from the deformation preventing member.

38. An apparatus according to claim 36, wherein the first elastic member is longer than the deformation preventing member in a circumferential direction of said transfer material supporting means.

39. An apparatus according to claim 35, wherein said transfer material supporting sheet rotates in contact with said image bearing member at the transfer position.

40. An apparatus according to claim 35, further comprising image transfer means inside the frame.

41. An apparatus according to claim 35, wherein plural color images are transferred from said image bearing member to the transfer material to provide a fullcolor image.

42. An apparatus according to claim 35, further comprising attracting means for electrostatically attracting the transfer material onto the transfer material supporting sheet.

43. An apparatus according to claim 35, further comprising stretching means, disposed in contact with the transfer material supporting sheet at a side thereof remote from said image bearing member, for stretching the transfer material supporting sheet.

44. An apparatus according to claim 43, wherein said stretching means is effective to increase a contact width between said image bearing member and the transfer material supporting sheet.

45. An apparatus according to claim 35, wherein at least one of the leading and trailing ends of the transfer material supporting sheet with respect to a rotational direction of said transfer material supporting means is fixed to the frame.

46. An apparatus according to claim 45, wherein said at least one of the ends is fixed to the connecting portion of the frame.

47. An apparatus according to claim 35, wherein the transfer material supporting sheet is detachably mountable to said frame.

48. An apparatus according to claim 35, wherein at least a part of the transfer material supporting sheet is unfixed to the frame at opposite longitudinal ends of the transfer material supporting means.

49. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, a frame for supporting a transfer material supporting sheet, and a stretching member for supporting the transfer material supporting sheet while stretching it;

wherein the stretching member applies tension to the transfer material supporting sheet by its urging force.

50. An apparatus according to claim 49, wherein said transfer material supporting sheet rotates in contact with said image bearing member at the transfer position.

51. An apparatus according to claim 49, further comprising image transfer means inside the frame.

52. An apparatus according to claim 49, wherein plural color images are transferred from said image bearing member to the transfer material to provide a full-color image.

53. An apparatus according to claim 49, wherein said transfer material supporting means is generally in the form of a drum.

54. An apparatus according to claim 49, further comprising attracting means for electrostatically attracting the transfer material onto the transfer material supporting sheet.

55. An apparatus according to claim 49, further comprising stretching means, disposed in contact with the transfer material supporting sheet at a side thereof remote from said image bearing member, for stretching the transfer material supporting sheet.

56. An apparatus according to claim 55, wherein said stretching means is effective to increase a contact width between said image bearing member and the transfer material supporting sheet.

57. An apparatus according to claim 49, wherein the frame includes ring portions at opposite ends and a connecting portion for partly connecting the ring portions to provide an opening defined by the ring portions and connecting portion, said opening being covered by the transfer material supporting sheet.

58. An apparatus according to claim 57, wherein at least one of the leading and trailing ends of the transfer material supporting sheet with respect to a rotational direction of said transfer material supporting means is fixed to the frame.

59. An apparatus according to claim 58, wherein said at least one of the ends is fixed to the connecting portion of the frame.

60. An apparatus according to claim 57, wherein at least a part of the transfer material supporting sheet is unfixed to the frame at opposite longitudinal ends of the transfer material supporting means.

61. An apparatus according to claim 49, wherein the transfer material supporting sheet is detachably mountable to said frame.

62. An apparatus according to claim 49, wherein at least a part of the transfer material supporting sheet is unfixed to the frame at opposite longitudinal ends of the transfer material supporting means.

63. An apparatus according to claim 49, wherein said stretching means is a spring.

64. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, a frame for supporting a transfer material supporting sheet, and a stretching member for supporting the transfer material supporting sheet while stretching it;

wherein the stretching member applies tension to the transfer material supporting sheet by its urging force, and wherein said stretching member connects the frame with the transfer material supporting sheet adjacent a circumferential end thereof.

65. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer station, said transfer material supporting means including a transfer material supporting sheet for supporting the transfer material, a frame for supporting a transfer material supporting sheet, and a stretching member for supporting the transfer material supporting sheet while stretching it;

wherein the stretching member applies tension to the transfer material supporting sheet by its urging force, and wherein said transfer material supporting means includes a supporting member for supporting the transfer material supporting sheet, and wherein said stretching member connects the supporting member and the frame.

66. An apparatus according to claim 65, wherein said transfer material supporting means includes an elastic member between the transfer material supporting sheet and said supporting member.

67. An image forming apparatus, comprising:

a movable image bearing member;

means for forming an image on said image bearing member;

means for transferring the image formed on said image bearing member onto a transfer material at a transfer position;

a rotatable transfer material supporting means for supporting the transfer material to bring it to the transfer position, said transfer material supporting means including a transfer material supporting sheet for supporting the transfer material, and a frame having ring portions at longitudinal opposite ends of said transfer material supporting means and a connecting portion for partly connecting the ring portions to provide an opening defined by the ring portions and the connecting portion, wherein the frame supports the transfer material supporting sheet to cover the opening;

wherein a friction coefficient between the transfer material supporting sheet and the ring portions is different depending on a circumferential position of said transfer material supporting means.

68. An apparatus according to claim 67, wherein the friction coefficient is larger at a leading side than at a trailing side with respect to a rotational direction of said transfer material supporting means.

69. An apparatus according to claim 67, further comprising a member for providing the friction coefficient different depending on the circumferential position.

70. An apparatus according to claim 67, wherein said transfer material supporting sheet rotates in contact with said image bearing member at the transfer position.

71. An apparatus according to claim 67, further comprising image transfer means inside the frame.

72. An apparatus according to claim 67, wherein color images are transferred from said image bearing member to the transfer material to provide a full-color image.

73. An apparatus according to claim 67, further comprising attracting means for electrostatically attracting the transfer material onto the transfer material supporting sheet.

74. An apparatus according to claim 67, further comprising stretching means, disposed in contact with the transfer material supporting sheet at a side thereof remote from said image bearing member, for urging the transfer material supporting sheet.

75. An apparatus according to claim 74, wherein said urging means is effective to increase a contact width between said image bearing member and the transfer material supporting sheet.

76. An apparatus according to claim 67, wherein at least one of the leading and trailing ends of the transfer material supporting sheet with respect to a rotational direction of said transfer material supporting means is fixed to the frame.

77. An apparatus according to claim 76, wherein said at least one of the ends is fixed to the connecting portion of the frame.

78. An apparatus according to claim 67, wherein the transfer material supporting sheet is detachably mountable to said frame.

79. An apparatus according to claim 67, wherein the transfer material supporting sheet is unfixed to the frame at opposite longitudinal ends thereof.

80. An apparatus according to claims 1, 22, 35, 49 or 67, further comprising cleaning means contactable to the transfer material supporting sheet to clean it.

81. An apparatus according to claim 1, 22, 35, 49 or 67, wherein the transfer material supporting sheet is of dielectric material.

* * * * *

UNITED STATES PATENT AND TRADEMARK OFFICE
CERTIFICATE OF CORRECTION

PATENT NO. : 5,084,736
DATED : January 28, 1992
INVENTOR(S) : SUZUKI, ET AL.

It is certified that error appears in the above-identified patent and that said Letters Patent is hereby corrected as shown below:

COLUMN 1

Line 62, "shrinked" should read --shrunk--.
Line 65, "property" should read --properly--.

COLUMN 2

Line 64, "be" should be deleted.

COLUMN 3

Line 7, "slacked" should read --slack--.
Line 15, "Fig. 1" should read --Fig. 1 is a--.

COLUMN 4

Line 45, "presents" should read --moves--.

COLUMN 5

Line 63, "sheet 348" should read --sheet 34--.
Line 64, "sheet 34" should read --sheet 34)--.
Line 65, "may be" should read --and may be--.

COLUMN 6

Line 61, "are" should read --being--.

UNITED STATES PATENT AND TRADEMARK OFFICE

CERTIFICATE OF CORRECTION

PATENT NO. : 5,084,736

DATED : January 28, 1992

INVENTOR(S) : SUZUKI, ET AL.

It is certified that error appears in the above-identified patent and that said Letters Patent is hereby corrected as shown below:

COLUMN 9

Line 16, "member 62" should read --member 62 is used--.
Line 67, "30d" should read --30D--.

COLUMN 10

Line 30, "drum 30d" should read --drum 30D--.

COLUMN 13

Line 10, "tively" should read --tive--.
Line 29, "fullcolor" should read --full-color--.

COLUMN 14

Line 14, "including" should read --includes--.

COLUMN 17

Line 21, "color" should read --plural color--.

Signed and Sealed this

Twenty-second Day of June, 1993

Attest:

Michael K. Kirk

MICHAEL K. KIRK

Attesting Officer

Acting Commissioner of Patents and Trademarks